US006591773B1

(12) United States Patent
Chang et al.

(10) Patent No.: US 6,591,773 B1
(45) Date of Patent: Jul. 15, 2003

(54) PROTECTIVE FENDERING SYSTEM FOR OFF-SHORE CARGO TRANSFERRING SURFACE SHIPS

(75) Inventors: Jason M. Chang, Bethesda, MD (US); Arthur Brisbane, Gaithersburg, MD (US); Bruce J. Yoon, Washington, DC (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/201,170

(22) Filed: Jul. 24, 2002

(51) Int. Cl.[7] ..... B63B 59/02
(52) U.S. Cl. ..... 114/219
(58) Field of Search ..... 114/219; 405/212; 414/137.1

(56) References Cited

U.S. PATENT DOCUMENTS 1,117,579 A 11/1914 Kause
3,554,527 A * 1/1971 Hall ..... 267/116
3,584,464 A * 6/1971 Saadeh et al. ..... 405/215
3,593,531 A * 7/1971 Saadeh et al. ..... 405/212
4,215,645 A * 8/1980 Moeller ..... 114/336
4,343,258 A 8/1982 Belvedere
4,406,241 A * 9/1983 Comte ..... 405/215
5,628,270 A 5/1997 Ryll et al.
5,740,752 A 4/1998 Allenbaugh
5,766,711 A 6/1998 Barmakian

* cited by examiner

*Primary Examiner*—Stephen Avila
(74) *Attorney, Agent, or Firm*—Jacob Shuster

(57) ABSTRACT

A protective system for covering the hull of a surface ship during off-shore transfer of cargo therefrom to a lighterage craft, includes a composite fender unit having a pair of elongated box sections with floatation buoyancy foam therein. The box sections are pivotally interconnected in assembled relation to each other by a base tray, accommodating displacement of the box sections from longitudinally aligned positions during storage on the ship to deployed positions in close laterally spaced relation to each other when filled with water while submerged to a depth wherein arch-shaped fender elements projecting from opposite sides of the box sections abut the hull of the ship and an approaching lighterage craft.

8 Claims, 3 Drawing Sheets

PROTECTIVE FENDERING SYSTEM FOR OFF-SHORE CARGO TRANSFERRING SURFACE SHIPS

STATEMENT OF GOVERNMENT INTEREST

The invention described herein may be manufactured and used by or for the Government of the United States of America for governmental purposes without the payment of any royalties thereon or therefore.

The present invention relates generally to protective fendering systems covering the side hulls of cargo surface ships.

BACKGROUND OF THE INVENTION

The transfer of cargo from an off-shore location to a ship at sea heretofore involved what is referred to as joint-logistic-over-the-shore operations, without use of port facilities. Such operations included approach of a smaller, lighterage craft to a position adjacent the larger cargo ship at which it is maintained by mooring while cargo is being transferred thereto by use of shipboard cranes and craft interfacing ramps and platforms. While moored adjacent to each other, protective fendering systems were hung over the sides of the ships and/or crafts, involving sausage fenders consisting of foam filled rubber shells. Such fenders were subject to various problems such as impact rupture, insufficient interfacing size and vessel imposing damage, especially under heavy weather conditions. It is therefore an important object of the present invention to provide a protective fendering system for surface ships during off-shore cargo transfer operations under heavy weather conditions, which avoids the durability, compatibility and operability problems heretofore experienced.

SUMMARY OF THE INVENTION

In accordance with the present invention, protective fendering covering the hull side of a water surface ship during off-shore transfer of cargo to a smaller lighterage craft, includes a fender unit formed from an assembly of elongated box sections respectively enclosing cavities with floatation buoyancy foam blocks therein and a base tray to which the box sections are pivotally linked for displacement relative thereto between stowage and deployed positions. In the stowage positions, the box sections extend horizontally from the base tray in longitudinal alignment with each other to accommodate storage. The fender unit in such stowage condition is lifted and deposited by shipboard crane into the water alongside of the cargo ship, causing the box sections to fill with water and thereby automatically rotate 90° to vertically deployed positions in which they are then locked in close laterally spaced relation to each other by a spreader bar. When so deployed, the fender unit sinks in the water to a depth predetermined by ballast weights at the bottom of each box section and on the bottom of the base tray. At such water submerged depth, portions of the deployed box sections project above the water surface level exposing pairs of arch-shaped vertical fender elements on one side partially above the water surface for abutment by an approaching lighterage craft that is to be moored to the cargo ship during transfer of cargo therefrom, while pairs of horizontal fender elements on the other sides of the box sections of the fender unit are respectively exposed above and below the water surface level for abutment with the cargo ship hull.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
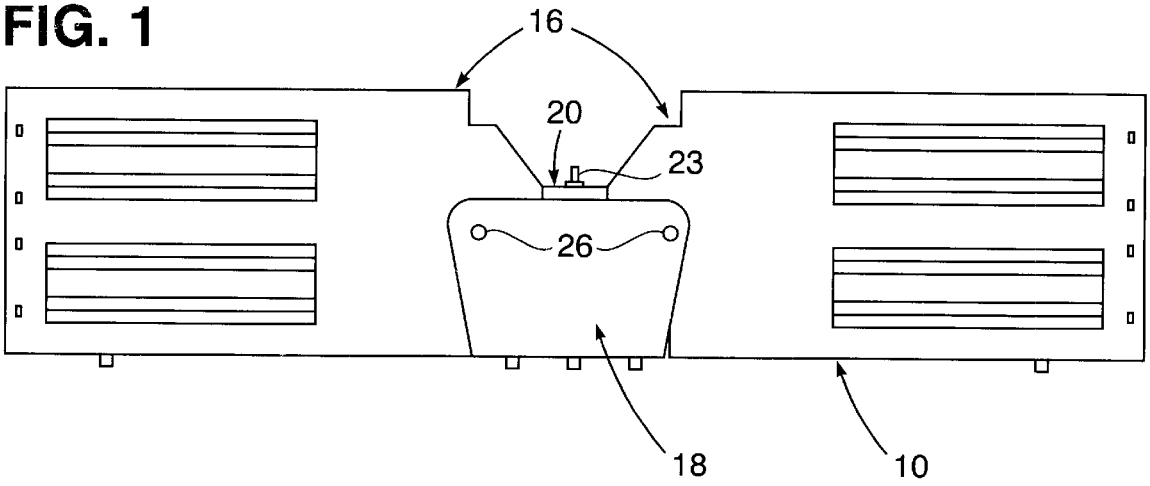
FIG. 1 is a front elevation view of a fender unit stored in a stowage condition.
Figure 2:
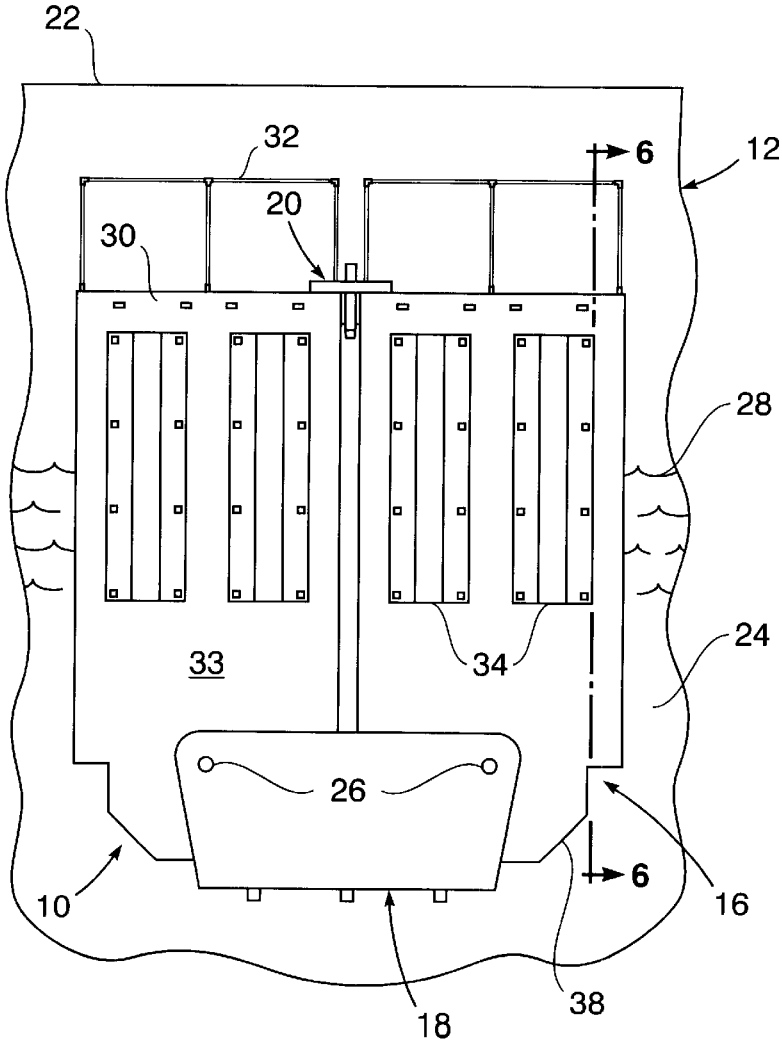
FIG. 2 is a front view of the fender unit in a deployed condition alongside of a cargo ship.
Figure 3:
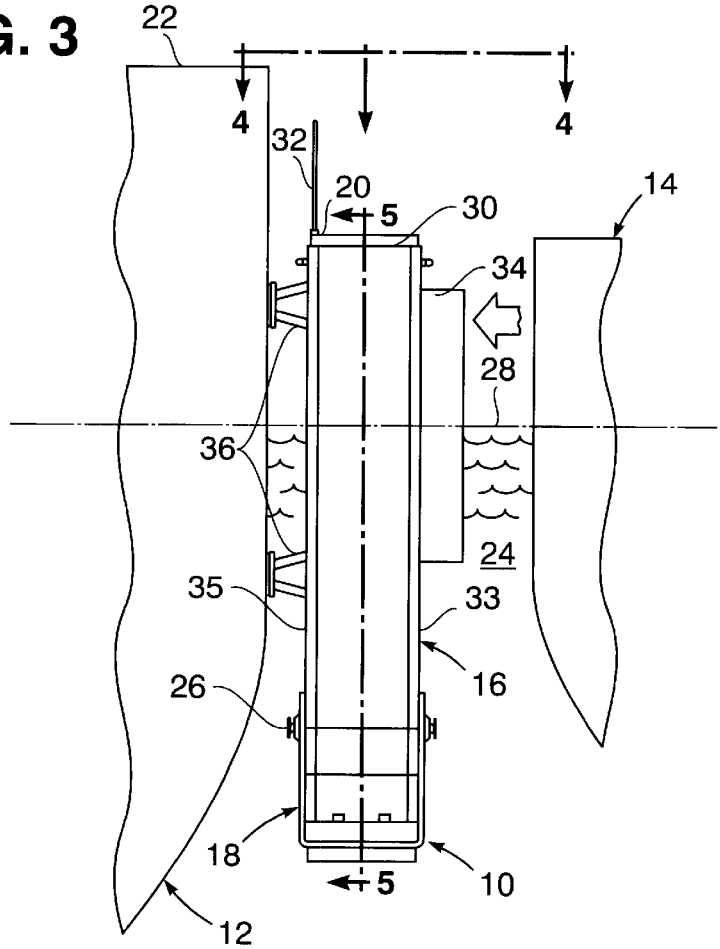
FIG. 3 is a side view of the deployed fender unit abutting the hull of the off-shore cargo ship with a lighterage craft approaching thereto.

Referring now to the drawing in detail, FIGS. 1–4 illustrate one of a plurality of composite fender units 10 adapted to be utilized as part of a protective fendering system between a surface cargo ship 12 and a lighterage craft 14 as shown approaching the cargo ship 12 in FIG. 3. Cargo is to be transferred off-shore from the ship 12 to the lighterage craft 14 without hull damage thereto, even under severe weather conditions. Each fendering unit 10, is assembled from three basic components consisting of a pair of elongated, rectangular-shaped, free-flooding box sections 16 and a base tray 18 to which the box sections 16 are pivotally connected.

Figure 4:
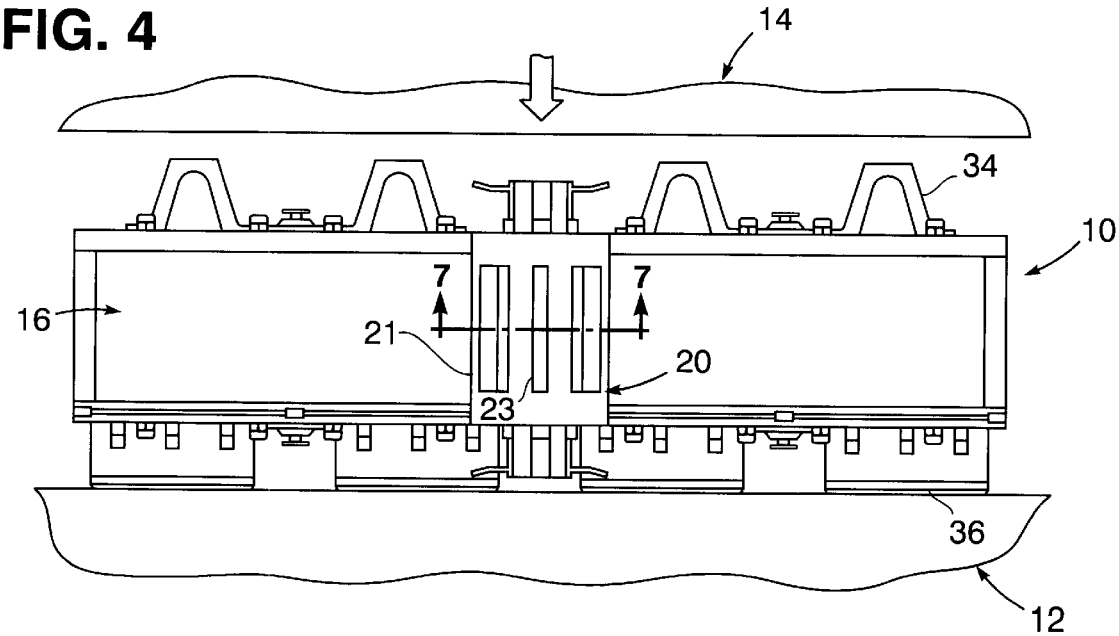
FIG. 4 is a partial top plan view as seen from a plane indicated by section line 4—4 in FIG. 3.

The fendering unit 10 in its stowage condition as shown in FIG. 1 has both of its box sections 16 held apart by a spreader 20 having a plate 21 disposed on a top side of the base tray 18 with a bar 23 projecting through the plate 21 between the box sections 16 which extend therefrom in longitudinal alignment with each other. In such stowage condition the fendering unit 10 may be stored on the deck 22 of the cargo ship 12, resting on the aligned bottom edges of the box sections 16 and the base tray 18. From such position the fendering unit 10 may be lifted by use of a shipboard crane and deposited into the body of water 24 alongside of the hull of the ship 12 for deployment purposes. The two box sections 16 of the fendering unit 10 during deployment from the stowage condition are pivotally displaced about pivot shafts 26 on the base tray 18 by 90° to positions in laterally spaced adjacency to each other as shown in FIG. 2. When so deployed, the fendering unit 10 is floatingly supported within the body of water 24, with the base tray 18 fully submerged below the box sections 16, which project above the water surface 28 to thereby expose their top end panels 30 having safety rails 32 attached thereto. In such deployed condition of the fendering unit 10, the box sections 16 are held closely spaced apart by the spreader 20 as shown in FIG. 2, with each box section 16 exposing on one side panel 33 thereof a pair of parallel spaced arch-shaped fender elements 34 adapted to abut the hull side of the lighterage craft 14, above and below the water surface 28, when moored to the ship 12. The side panels 35 on the other side of each box section 16 has a pair of spaced fender elements 36 attached thereto, abutting the hull of the cargo ship 12 as shown in FIGS. 3 and 4.

Figure 5:
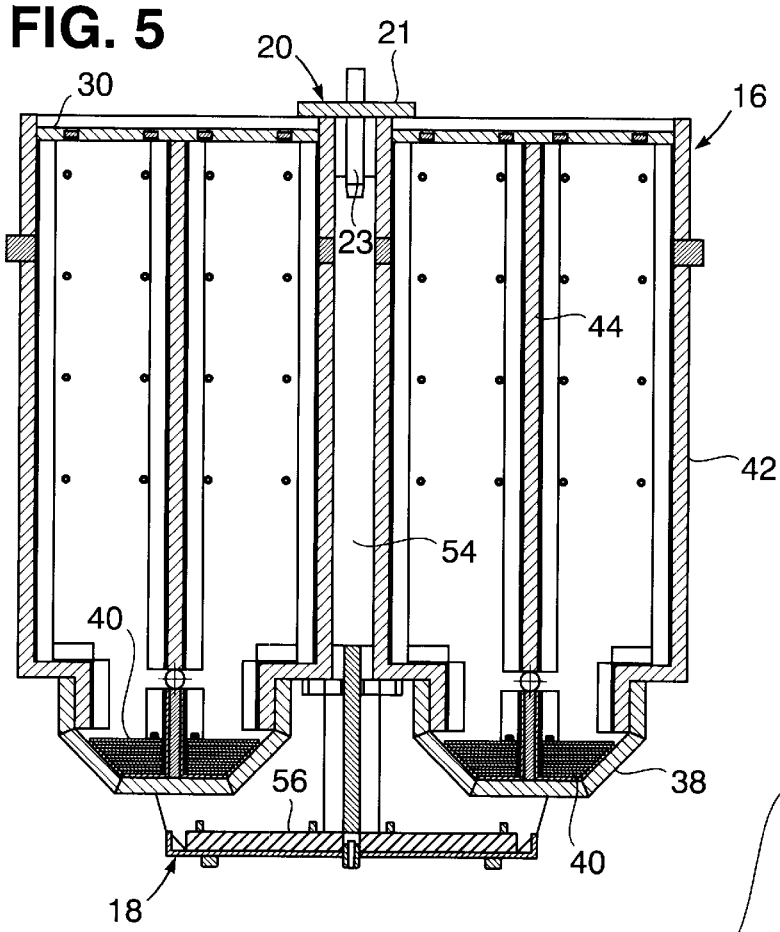
FIG. 5 is a section view taken substantially through a plane indicated by section line 5—5 in FIG. 3.
Figure 6:
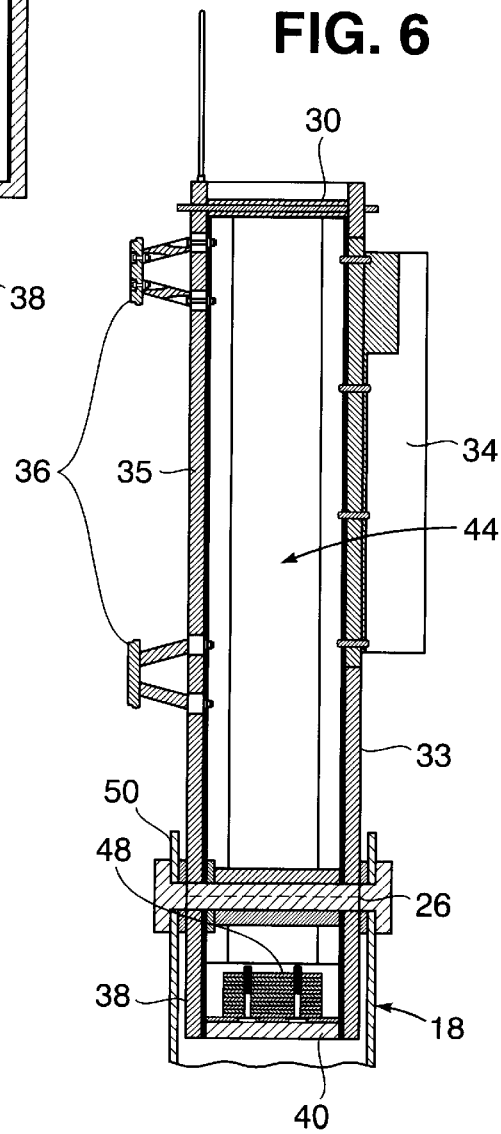
FIG. 6 is a section view taken substantially through a plane indicated by section line 6—6 in FIG. 2.
Figure 7:
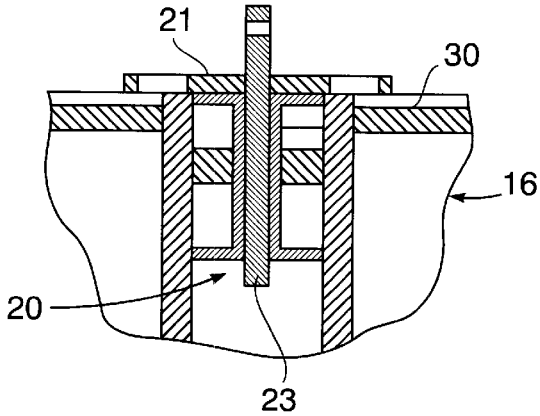
FIG. 7 is a partial section view taken substantially through a plane indicated by section line 7—7 in FIG. 4.

Referring now to FIGS. 5 and 6, the side panels 33 and 35 of each of the box 24 sections 16 have bottom end portions 38 tapered to avoid interference with pivotal displacement. Such bottom portions 38 of the box sections 16 are interconnected by bottom end panels 40. Lateral end panels 42 having openings therein for entry and drainage of water interconnect the side panels 33 and 35 to enclose a water flooded cavity which is filled adjacent its top end panel 30 with a foam block for providing floating buoyancy. Each of the box sections 16 also has an inner bulkhead 44 within its enclosed cavity to provide the requisite strength and rigidity to the rendering unit 10. All of the cavity enclosing portions of the box sections 16 are made of a reinforced corrosion-resisting plastic and have sleeves 46 extending between the lower ends of the side panels 33 and 35 through which the pivot shaft 26 extends from the base tray 18 as shown in FIG. 6. A plurality of weight plates 48 may be fixedly positioned by fasteners on the bottom panel 40 to adjust the buoyancy imposed on the rendering unit 10 by the cavity foam in the box sections 16 and the ballast weight of the base tray 18, for floating support of the fendering unit 10 at the desired water level as shown in FIG. 3.

It will be apparent from the foregoing description that the tapered bottom portions 38 of the box sections 16 of the fendering unit 10, allow them to be pivotally displaced relative to the base tray 18 between the positions respectively shown in FIGS. 1 and 2. In the stowage condition, the fendering unit 10 may be readily stored on the flat deck 22 of the cargo ship 12 or in its cargo hold, from which storage location the fendering unit 10 may be readily lifted and placed in the water. As the box sections 16 then fill with water, they automatically rotate 90° about the base tray pivot shafts 26 to their deployed positions at which they are then locked in place by the spreader 20 and moored to the ship 12. A plurality of such rendering units 10 may be so deployed in laterally spaced relation to each other on the hull side of the cargo ship 12. The gaps formed between each of the fendering units 10 are filled by sausage fenders placed therein to assure full coverage of the ship hull by a rendering system having advantages introduced by rendering units 10 of the present invention.

Obviously; other modifications and variations of the present invention may be possible in light of the foregoing teachings. It is therefore to be understood that within the scope of the appended claims the invention may be practiced otherwise than as specifically described.

What is claimed is:

1. In combination with a protection system for covering of a hull of a surface ship while floatingly supported in a body of water during transfer of cargo therefrom to lighterage craft, the improvement residing in a fender unit, comprising: cavity enclosing floatation means responsive to submergence within said body of water for receiving the water therein; base means operatively mounting the cavity enclosing floatation means for displacement from a stowage condition to a deployed condition in response to the cavity enclosing floatation means being filled with the water received therein while partially submerged to a predetermined depth in the body of water; and fender elements projecting from opposite sides of the cavity enclosing floatation means to respectively abut the hull of the ship when the cavity enclosing floatation means is in said deployed condition and project into abutment with the lighterage craft.

2. The improvement as defined in claim 1, wherein said cavity enclosing floatation means comprises: elongated box sections having openings therein through which the water enters and drains and respectively enclosing therein floatation buoyancy foam.

3. The improvement as defined in claim 2, wherein said base means comprises: a tray; means pivotally connecting the elongated box sections to the tray for limiting said displacement thereof between the stowage condition in longitudinal alignment with each other and the deployed condition in close lateral spaced relation to each other; and ballast weight means fastened to the tray for inducing said submergence to the predetermined depth.

4. The improvement as defined in claim 1, wherein said base means comprises: a tray to which the cavity enclosing floatation means is pivotally connected; and ballast weight means fastened to the tray for inducing said submergence to the predetermined depth.

5. The combination as defined in claim 3, wherein each of the fender elements on one of the opposite sides of the elongated box sections extends vertically above and below a surface level of the body of water in the deployed condition, while the fender elements on the other of the opposite sides extend horizontally in parallel spaced relation, respectively above and below said surface level of the body of water.

6. The combination as defined in claim 5, wherein the fender elements on said one of the opposite sides of the box sections in the deployed condition thereof abut the hull of the surface ship.

7. In combination with a water surface cargo ship having a hull submerged in a body of water, a system for protecting said hull of the ship during off-shore transfer of cargo therefrom, comprising: a rendering unit transferred from stowage on the ship into said body of water; and deployment means responsive to submergence of the fendering unit to a predetermined depth within the body of water for holding thereof in abutment with the hull.

8. The combination as defined in claim 7, wherein the rendering unit includes: a pair of elongated box sections; and base means pivotally interconnecting said box sections for displacement thereof between longitudinally aligned positions and laterally spaced positions.

* * * * *